US005315812A

United States Patent [19]

Germunson

[11] Patent Number: 5,315,812

[45] Date of Patent: May 31, 1994

[54] METHOD AND APPARATUS FOR BAGGING OBJECTS

[75] Inventor: Gary G. Germunson, Yakima, Wash.

[73] Assignee: Yakima Wire Works, Yakima, Wash.

[21] Appl. No.: 873,427

[22] Filed: Apr. 23, 1992

[51] Int. Cl.[5] ..... B65B 5/04; B65B 39/02; B65B 43/34; B65B 43/16

[52] U.S. Cl. ..... 53/573; 53/260; 53/261; 53/384.1; 53/385.1

[58] Field of Search ..... 53/468, 469, 384.1, 53/385.1, 571, 260, 261, 255, 459, 573

[56] References Cited

U.S. PATENT DOCUMENTS

| | | | |
|---|---|---|---|
| Re. 32,963 | 6/1989 | Lerner et al. | 53/385.1 X |
| 2,348,144 | 5/1944 | Opie | 53/261 |
| 2,350,666 | 6/1944 | Allen | 226/49 |
| 2,561,410 | 7/1951 | Peters | 53/261 |
| 2,608,332 | 8/1952 | Pottle | 53/261 X |
| 2,722,358 | 11/1955 | Wilson | 226/49 |
| 2,901,875 | 9/1959 | Hultkrans et al. | 53/384.1 X |
| 3,011,297 | 12/1961 | McDevitt | 53/261 |
| 3,022,551 | 2/1962 | Marburg | 22/31 |
| 3,138,907 | 6/1964 | Gerbe | 53/571 X |
| 3,720,435 | 3/1973 | Leyn | 294/88 |
| 3,822,527 | 7/1974 | Germunson et al. | 53/189 |
| 3,879,918 | 4/1975 | Lerner | 53/385.1 X |
| 4,300,327 | 11/1981 | Bridger | 53/255 X |
| 4,487,546 | 12/1984 | Cassinelli | 414/751 |
| 4,974,393 | 12/1990 | Rich et al. | 53/469 |
| 5,056,300 | 11/1991 | Suzuki et al. | 53/572 |
| 5,088,267 | 2/1992 | Gee | 53/86 |

*Primary Examiner*—Horace M. Culver
*Attorney, Agent, or Firm*—Seed and Berry

[57] ABSTRACT

A method and apparatus for bagging a cylindrical object in one bag in a plurality of bags. The apparatus includes a finger assembly with fingers that are placed into a partially opened open end of the bag that is to receive the cylindrical object. After insertion into the open end of the bag, the fingers are separated uniformly in all directions and moved away from the rest of the bags, providing an appropriately shaped opening for the object to pass into the bag. The object passes through the expanded plurality of fingers into the opened open end of the bag. After the bag has been filled, a gripper finger grasps one edge of the bag and the finger assembly moves upwardly away from the bag as the bag is pulled onto a conveyor, where the bag is closed in a bag closure machine.

8 Claims, 6 Drawing Sheets

METHOD AND APPARATUS FOR BAGGING OBJECTS

TECHNICAL FIELD

This invention relates to a method and apparatus for handling flexible bags, and more particularly, to a method and apparatus for placing an object, such as a cylinder, in a flexible bag.

BACKGROUND OF THE INVENTION

Present methods and apparatus for bagging items are most typically directed toward bagging items which are supplied in bulk. Examples of such materials are fruits, vegetables, grains and sand. A given volume of these bulk items generally can be poured into any shape of open end of a bag in which the items are to be contained. However, there is also a need to bag large items, such as cylindrical items, which require the open end of the bag be opened to a circular shape. Examples of such items which have cylindrical shapes are rolls of plastic sheeting and paper towels.

It is also of interest to minimize the cost of bagging items. One way toward accomplishing this goal is to minimize the sizes of the bags in which the items are packaged. In the case of cylindrical items, it is possible to accomplish this by putting the items in bags having approximately the same outer perimeter.

SUMMARY OF THE INVENTION

According to one aspect, the invention is an apparatus for opening the open end of a flexible bag having a permanently closed end and an open end. The apparatus comprises means for partially opening the open end of the bag, and finger means for inserting into the partially opened open end and expanding the open end substantially uniformly in all directions after insertion thereinto to further open the partially opened open end.

According to another aspect, the invention is a method for opening the open end of a flexible bag having a permanently closed end and an openable open end. The method comprises the steps of (a) inserting finger means into the partially open end of the bag, and (b) then expanding the open end of the bag substantially uniformly in all directions to open the open end.

BRIEF DESCRIPTION OF THE DRAWINGS

FIGS. 4A–C are top views of the finger assembly shown in FIGS. 2 and 3, showing the finger assembly in various stages of its operation.

DETAILED DESCRIPTION OF THE INVENTION

Figure 1:
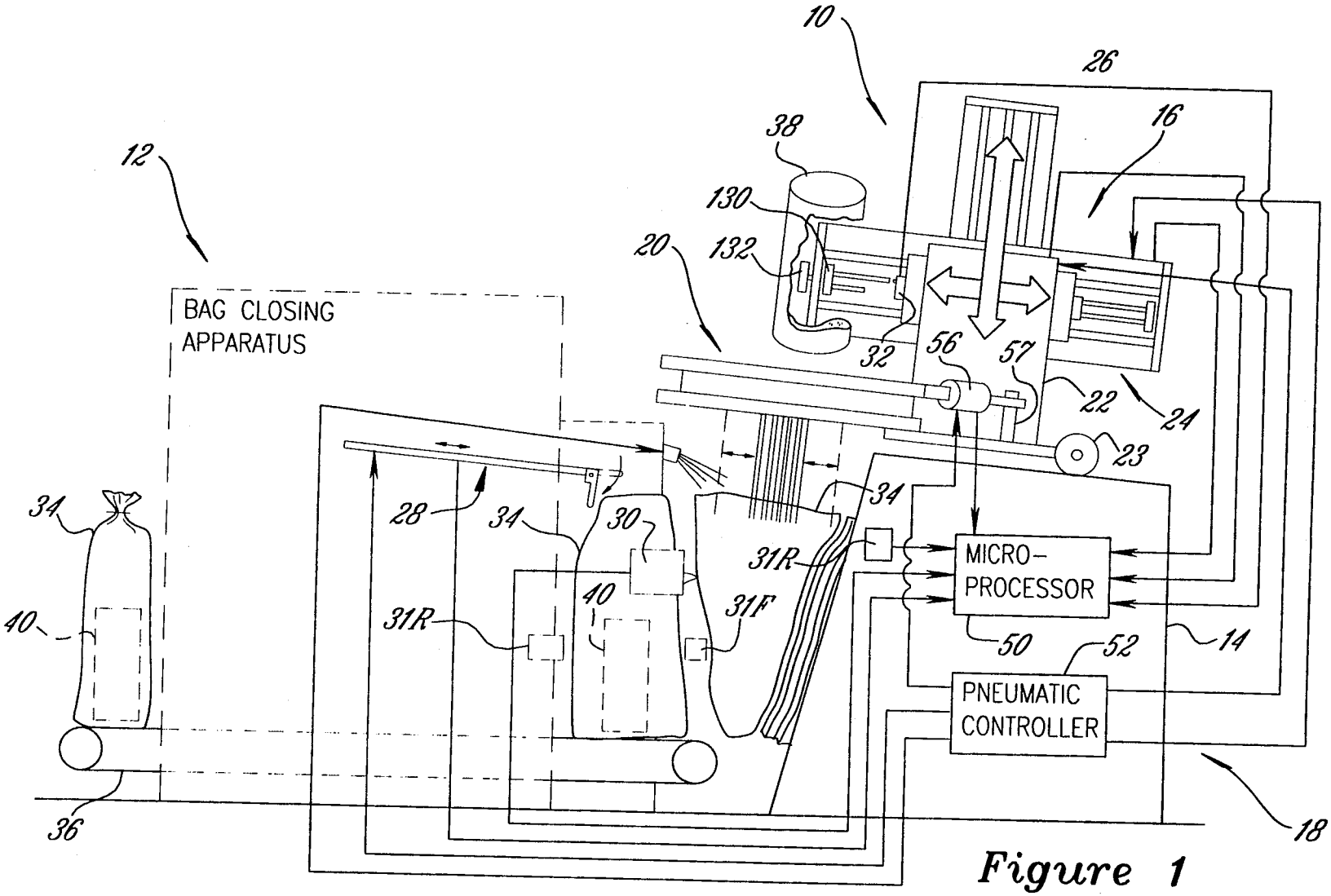
FIG. 1 is a schematic diagram illustrating the control circuit and components of an apparatus for bagging a cylindrical object.

As best shown in FIG. 1, the apparatus for bagging a cylindrical object includes a bagging apparatus 10 for placing the objects, such as cylindrical objects, in bags, and a bag closing apparatus 12. The bagging apparatus includes a base 14 which supports a movement mechanism 16 and control circuitry 18. The movement mechanism includes a finger assembly 20 which is connected, through a support 22 and a wheel 23, to a horizontal actuator 24. The horizontal actuator, in turn, is connected to a vertical actuator 26. The coordinated movements of the finger assembly, support, horizontal actuator, and vertical actuator will be described subsequently. The movement mechanism further includes a gripping means 28, a proximity switch 30, and an air blast means 33. The base also supports a plurality of transparent flexible bags 34, which are conventionally dispensed from a package of bags held together by a wicket. Each bag in the plurality of bags has a permanently closed end disposed downward and an open end disposed upward. The term "open end" is used herein to define the end opposite the permanently closed end, it being understood that the open end is initially flattened or closed but can be expanded or opened. The bags attached to the base are held near the finger assembly and are supplied collapsed so that the openings in their open ends are closed. There is also a conveyor 36 that is located near the bags and used to transport a bag from the bagging apparatus to the bag closing apparatus after the bag has been filled with a cylindrical object 40. The bagging apparatus also includes a chute 38 which directs the cylindrical objects to be bagged through the finger assembly.

The control circuitry 18 includes a microprocessor 50 which is connected to a pneumatic controller 52 through a cable 54. The pneumatic controller includes means for sending pneumatic signals to actuate pneumatic cylinders. One of the cylinders is cylinder 56, which actuates the finger assembly 20. Other pneumatic cylinders are built in to the horizontal actuator 24, the vertical actuator 26, and the gripping means 28. The microprocessor 50 is programmed in a conventional manner to control the pneumatic signals produced by the pneumatic controller 52, which, in turn, controls the movements of the bagging apparatus 10. The microprocessor bases its control actions on electrical signals received from the pneumatic cylinders, a proximity switch 30, a photodiode-detector pair 31, and a switch 32. The electrical signals from each of the pneumatic cylinders are produced by built-in reed switches that actuate when the piston in that cylinder reaches or leaves an extreme of its travel. The electrical signal from the proximity switch is produced each time a bag is fully opened by the finger assembly. The electrical signal from the photodiode-detector pair is produced when the light beam transmitted by the photodiode 31T toward the photodetector 31R is interrupted by a cylindrical object 40 inside a bag 34. If the bag is not transparent, other means for detecting the presence of a cylindrical object in the bag will be known to those skilled in the art.

The bag closing apparatus 12 receives the bags 34 after they have been filled with the cylindrical object 40. A filled bag 34 is brought to the bag closing apparatus 12 by the conveyor 36 and the gripping means 28, which grabs an edge of an opening of the bag 34 and simultaneously pulls the bag from the bagging apparatus to the bag closing apparatus and detaches the filled bag 34 from the plurality of bags 34 supported by the base 14.

Figure 2A:
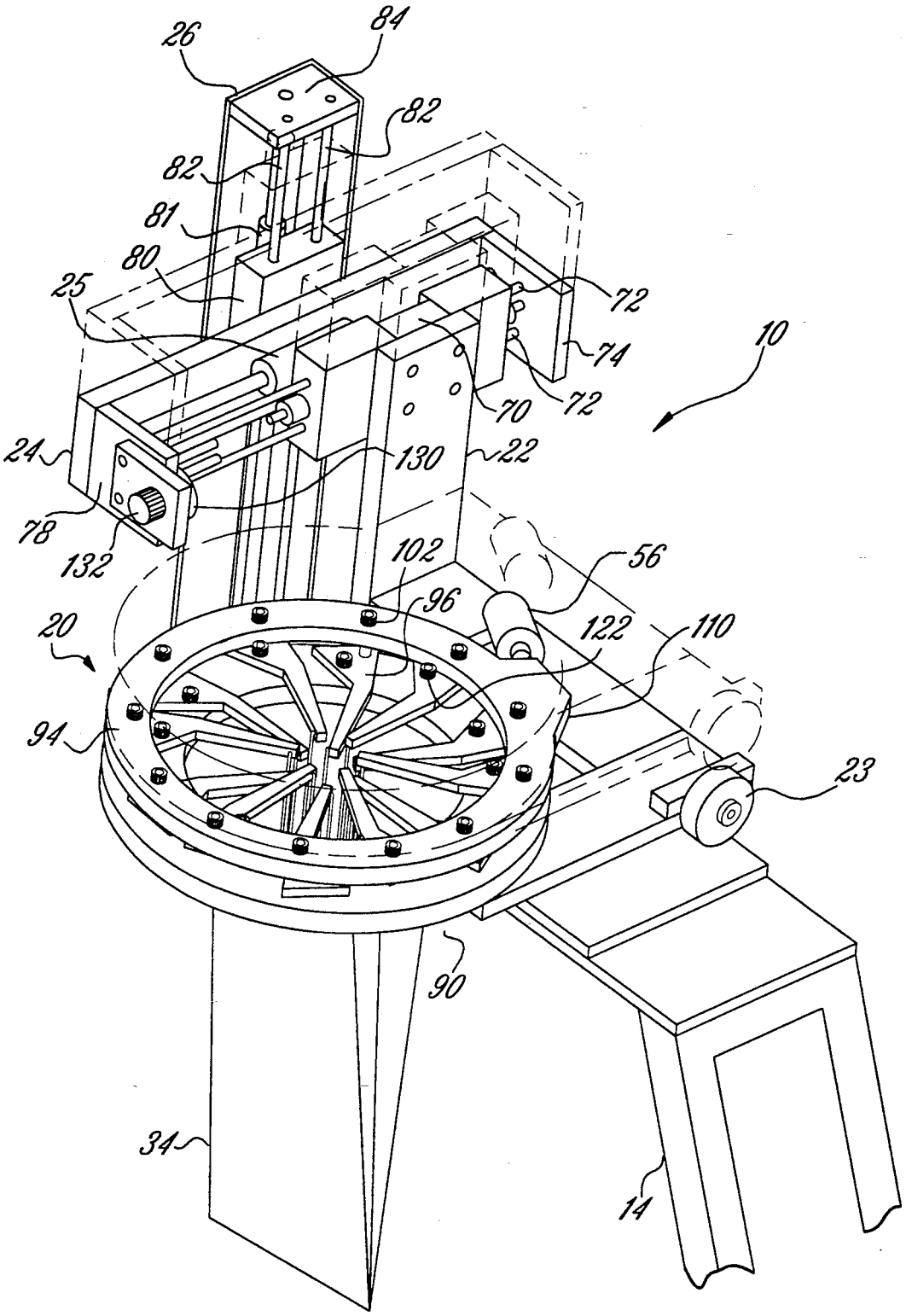
FIGS. 2A and 2B are detailed views of the movement mechanism and finger assembly in the bagging apparatus shown in FIG. 1, showing the bagging apparatus in four distinct positions.
Figure 2B:
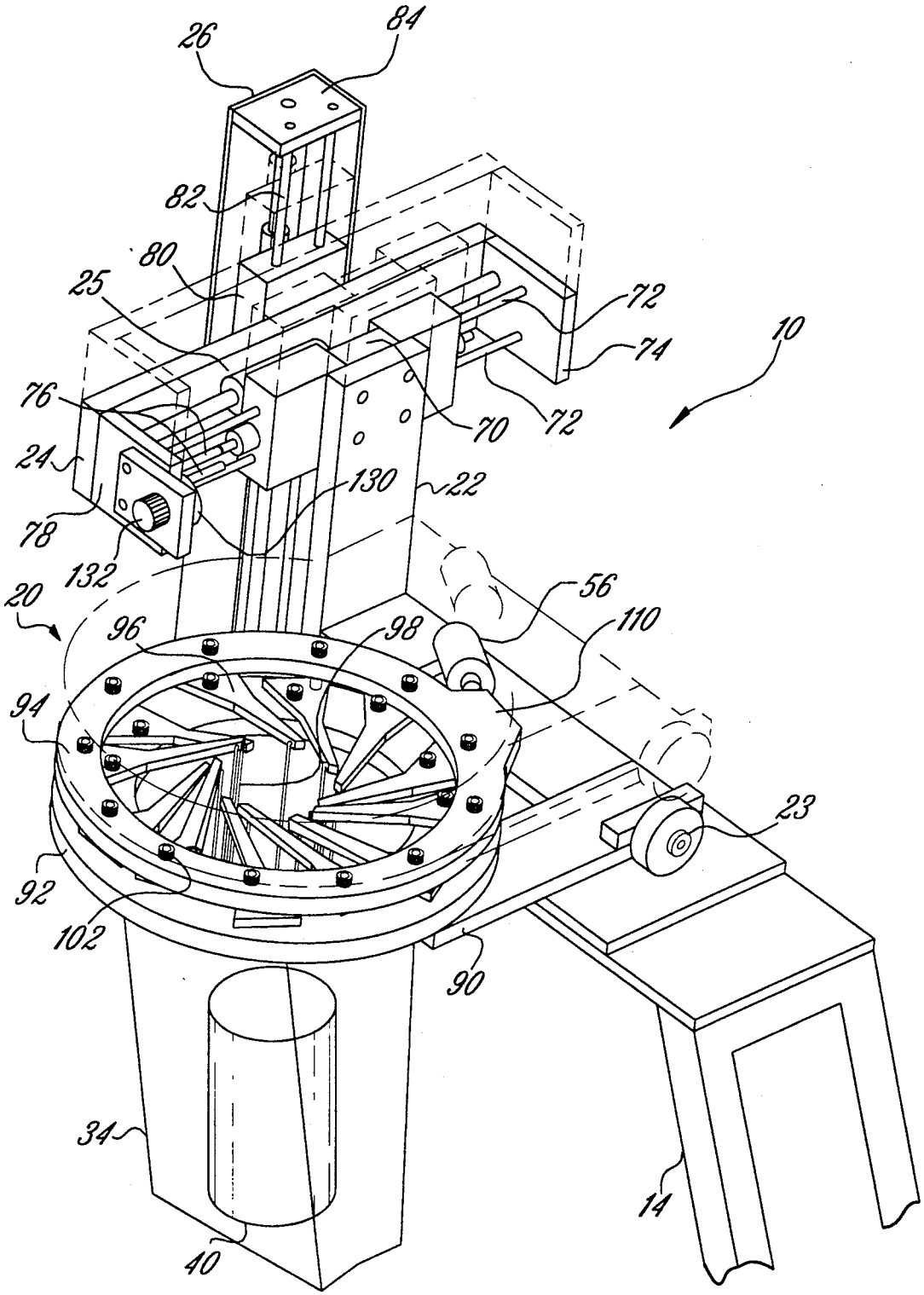
Figure 3:
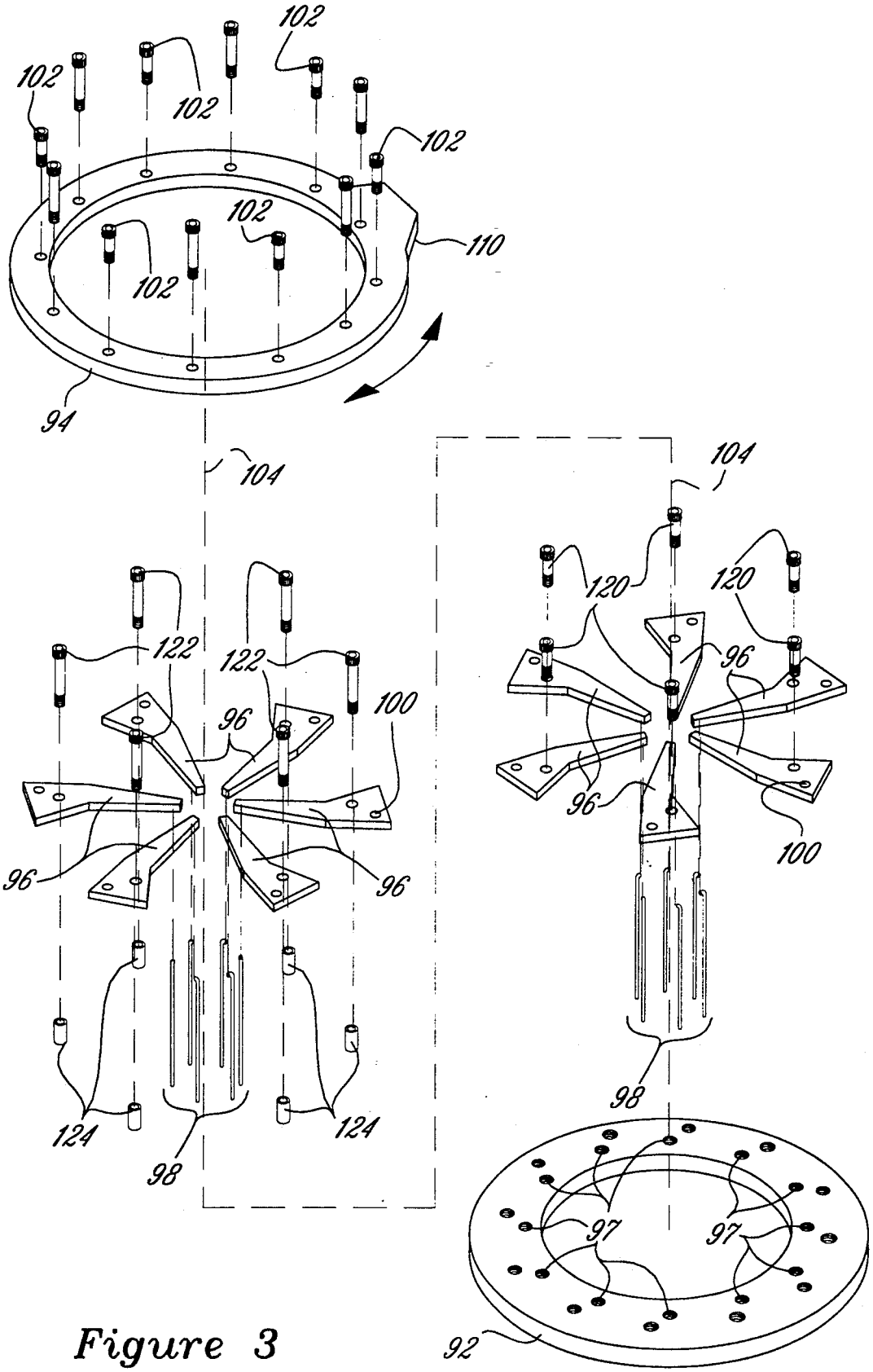
FIG. 3 is an exploded view of the finger assembly in the apparatus shown in FIGS. 2A and 2B.

FIGS. 2A and 2B are detailed views of the movement mechanism 16 and finger assembly 20 in the bagging apparatus 10 shown in FIG. 1. FIG. 3 is an exploded view of the finger assembly in the apparatus shown in FIGS. 2A and 2B. The horizontal actuator 24 of the movement mechanism includes a slide 70 that is actuated by a pneumatic cylinder 25 mounted on a pair of rails 72. The pneumatic cylinder in the horizontal actuator includes a reed switch that produces a signal when the slide 70 arrives at or leaves the right-hand end of the horizontal actuator. The switch 32 produces a signal when the horizontal actuator approaches or leaves its left-hand end. The horizontal actuator causes the finger assembly, which is connected to the horizontal actuator through the support 22, to move parallel to the direction of movement of the slide. The limits of travel of the slide on the rails are determined mechanically. The horizontal motion of the slide to the right is limited by the end wall 74. The movement of the slide to the left is stopped by a stop 76, which is one of a plurality of selectable stops mounted to the end wall 78. The stop actuates the switch 32. Further details of the stop 76 will be discussed subsequently.

The horizontal actuator 24 is attached to the vertical actuator 26, which also includes a slide 80 attached to a pair of rails 82. The slide 80 is moved by a cylinder 81 controlled by the pneumatic controller 52 (see FIG. 1). Both the upper and lower limits of travel of the slide 80 are determined mechanically by end walls 84.

The finger assembly 20 is attached to the support 22 by a pair of horizontally oriented brackets 90. As shown in FIGS. 2A–B and 3, the finger assembly includes a lower annular ring 92 and an upper annular ring 94. The lower annular ring is fixedly attached to the brackets. The finger assembly also includes a plurality of arms 96, placed between the lower and upper annular rings. One end of each of the arms is pivotally attached to bolt 122. The bolt 12 threads into a pivot hole 97 on the lower annular ring, and the other end of each of the arms extends toward the center of the lower annular ring and includes a downwardly directed finger 98. The fingers extend downwardly to substantially the same level and are long enough that they can be inserted into a bag 34 (see FIG. 1) when the vertical actuator 26 has caused the finger assembly 20 to be moved downwardly as far as possible, and yet are short enough that the fingers 98 are withdrawn from the bag when the vertical actuator 26 has caused the finger assembly 20 to move to its upward vertical extreme. The pivoting end of each of the arms 96 also includes a tapped hole 100. The upper annular ring 94 includes a plurality of downwardly pointing bolts 102 which screw into the corresponding tapped holes 100. The tapped holes are at a greater radial distance from the common center line 104 of the two annular rings than are the pivot holes 97. By this arrangement, a counterclockwise motion of the upper annular ring relative to the lower annular ring causes each of the arms 96 to rotate in a counterclockwise direction. This, in turn, causes the fingers 98 to become uniformly separated.

In operation, the movements of the upper annular ring 94 relative to the lower annular ring 92 are controlled by the pneumatic cylinder 56 which is connected between the post 57 on the support 22 and a flange 110 projecting from the upper annular ring. The pneumatic cylinder receives signals from the pneumatic controller 52 (see FIG. 1), which causes the plurality of fingers 98 to be controlled between a first configuration, in which the plurality of fingers are closely grouped together, and a second configuration, in which the plurality of fingers are widely separated. As will be described in more detail subsequently, these movements of the fingers 98 and the motion of the finger assembly 20 under the control of the horizontal actuator 24 and the vertical actuator 26 can open the open end of a bag 34. This makes the opening substantially circular and leaves an aperture along the axis 104 through the two annular rings. Accordingly, cylindrical objects 40 can pass through the chute 38 (see FIG. 1) and annular rings into a bag which is held open by the fingers 98.

In the preferred embodiment of the invention, the arms 96 are separated into two groups. Half of the arms pivot around short pivot bolts 120, while the other half of the arms pivot around long pivot bolts 122. The arms which pivot around the long pivot bolts are held above the level of the arms that pivot around the short pivot bolts by spacers 124. The bolts 102 which project downwardly from the upper annular ring fit into the tapped holes 100 and support the upper annular ring away from the lower annular ring.

Figure 4A:
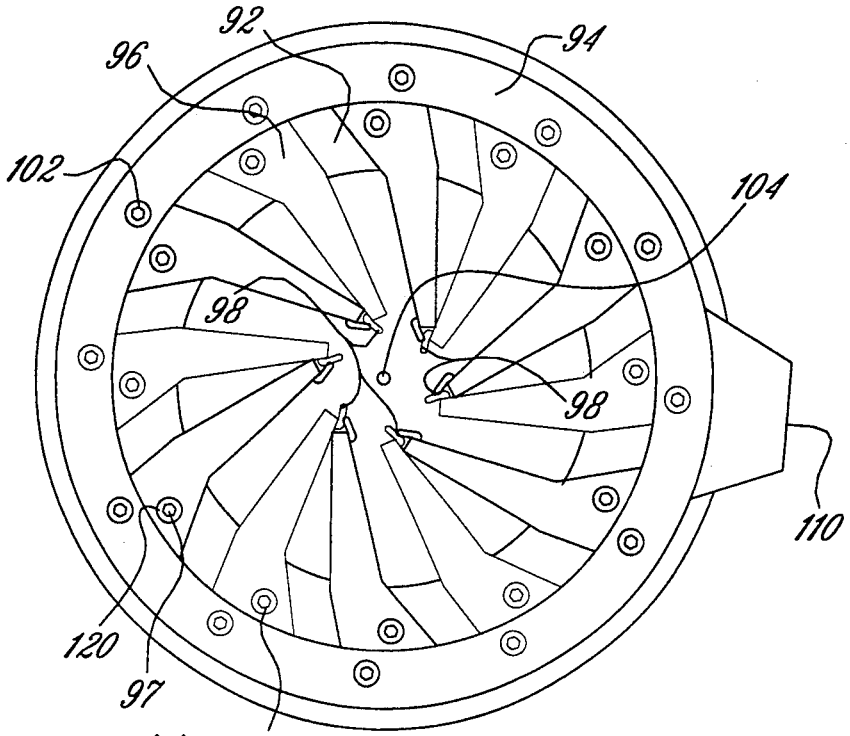
Figure 4B:
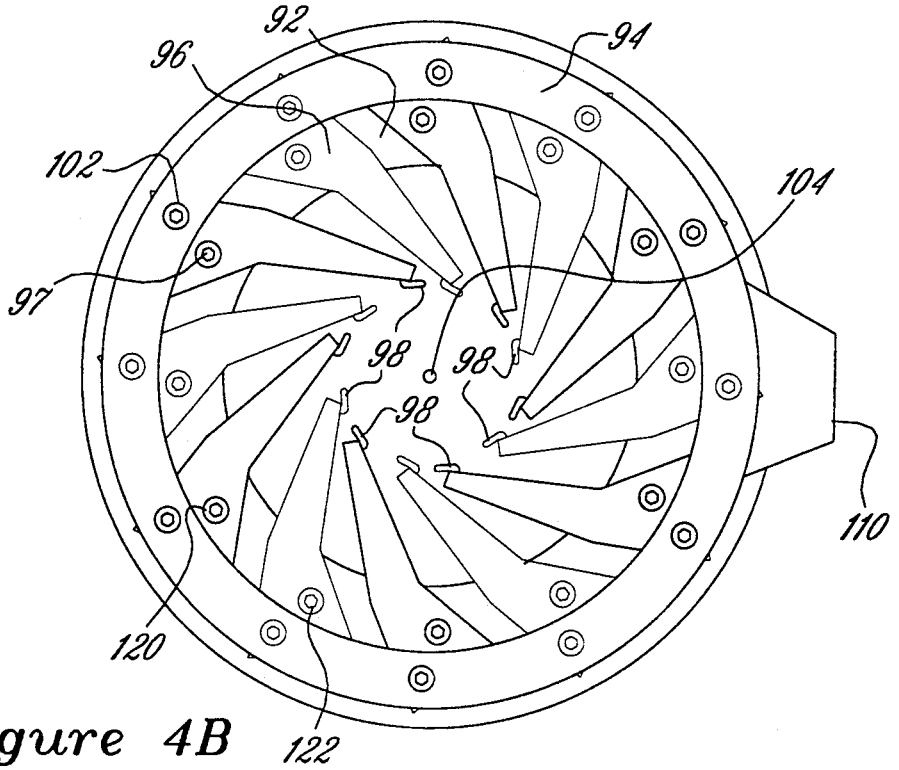
Figure 1A:
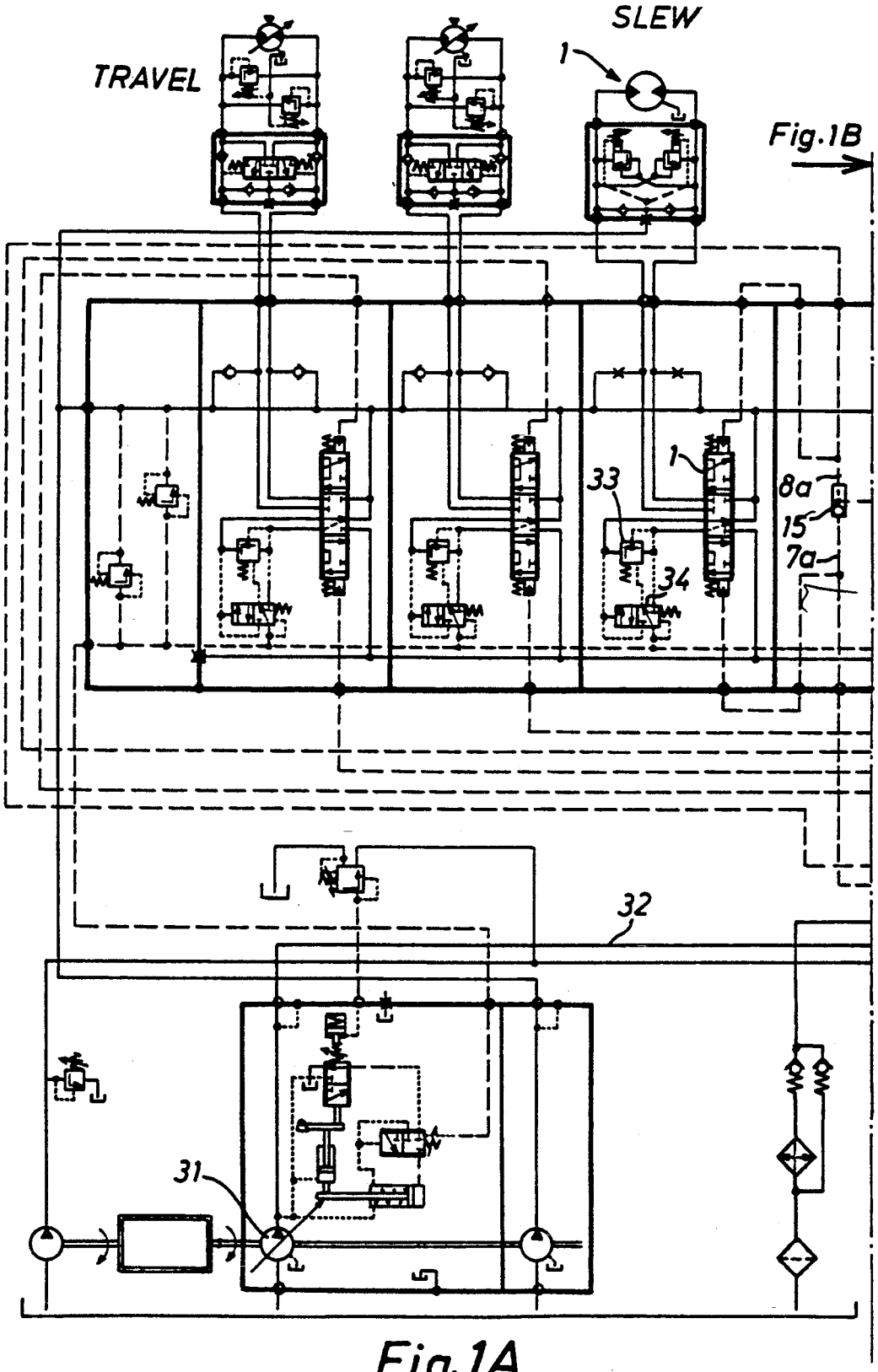

FIGS. 4A–C are top views of the finger assembly shown in FIGS. 2A–B and 3, showing the finger assembly in various stages of its operation. In FIG. 4A, the upper annular ring 94 is rotated clockwise to the fullest extent possible relative to the lower annular ring 92. This causes each of the arms 96 and the fingers 98, which are attached to the arms, to rotate clockwise so that the fingers are very closely spaced. As the upper annular ring is rotated counterclockwise, each of the arms rotates counterclockwise by the same amount, causing the separation between the fingers to open uniformly (see FIG. 4B). At the full counterclockwise rotation of the upper annular ring relative to the lower annular ring (see FIG. 4C), the fingers 98 are as widely separated as possible, providing a large aperture between them between through which cylindrical objects can be passed.

The shape of the opened open end of the bag 34 is determined by the number and placement of the fingers 98. If it is desired to provide a circular opening for entry of the objects 40 into the bag 34, a large number of fingers are desirable. If, on the other hand, a square opening in the bag 34 is desired, only four fingers are necessary. If desired, fingers can be removed from some of the arms to hold the bag open in virtually any desired configuration. As shown in FIG. 1, the proximity switch 30 is located so that it is engaged by the bag and actuated when the bag 34 is held open by the fingers 98. Upon receipt of a signal from the proximity switch, the microprocessor 50 causes a cylindrical object 40 to be dropped through the chute 38 and the plurality of fingers into the bag.

In operation, the bagging apparatus 10 produces a blast of air through the air blast means 33 (see FIG. 1) under control of the microprocessor 50. This blast of air partially opens an opening in the outer bag 34 in the wicket on the base 14. While the opening on the bag is held partially open by the blast of air, the movement mechanism 16 causes the group of fingers to be held together closely and moved downwardly into the opening (solid lines in FIG. 2B). After the finger assembly 20 has reached its furthest downward extent, the movement mechanism moves to the left at the same time that the plurality of fingers are opened to their most widely separated positions. This opens the opening of the bag 34 to its fullest extent, as signified by the signal produced by the proximity switch 30 (solid lines in FIG. 2A).

The microprocessor 50 verifies that a cylindrical object 40 has been dropped through the finger assembly 20 into the opened bag by receiving a signal from the photodiode-detector pair 31 which detected the object in the bag. Next, the microprocessor commands the pneumatic controller 52 to cause the gripping means 28 to grasp an edge of the opening of the bag 34 and pull the bag onto the conveyor 36 while simultaneously detaching the bag from the remaining group of bags. The group of fingers also begins to gather closer together and move vertically, out of the way of the moving bag (dashed lines in FIG. 2A). After it reaches its fullest vertical extent, the finger assembly is then returned to the right, where it is ready to fill the next bag (dashed lines in FIG. 2B).

It is sometimes desirable to revise the bagging apparatus 10 so that it can place objects in different sized bags. This is accomplished by changing the leftward extreme of travel by the horizontal actuator 24. The mechanism for accomplishing this is by choosing the stop 76 from among a parallel plurality of rods having different lengths. The plurality of rods can be rotated about a horizontal axis that is also parallel to the rods until a rod of proper length is in position. This mechanism is located at the left end of the horizontal actuator. Any one of the rods can be chosen to define the leftward extreme of horizontal movement by positioning that rod along the horizontal path traveled by the horizontal actuator 24. In a preferred embodiment, this mechanism is attached to the left-hand wall 78 of the horizontal actuator, the stops 76 being located on a circular plate 130 that is controlled by a knob 132. Rotating the knob 132 causes a stop of the appropriate length to be rotated between the rails 72 of the horizontal actuator.

While the preferred embodiment of the invention has been illustrated and described, it should be understood that variations and modifications will be apparent to one skilled in the art without departing from the principles of the invention. For example, objects other than cylindrical objects can be poured into the bag. Accordingly, the invention is not to be limited to the specific embodiments described.

I claim:

1. An apparatus for opening the open end of a flexible bag having a permanently closed end and an open end for placing an object of generally a similar shape as the shape of the fully opened open end into the bag, comprising:

means for partially opening the open end of the bag; and finger means for inserting into the partially opened open end and expanding the open end substantially uniformly in all directions by pivoting the fingers simultaneously with a radial component after insertion thereinto to further open the partially opened open end into an object receiving condition, and means for delivering the object through the opened open end to contain the object within the bag, wherein the finger means comprises a first annular ring having a center aperture having a central axis and a plurality of arms pivotally attached to said first annular ring, each arm having one of the fingers attached thereto and means for causing each of the arms to pivot, each of the fingers extending into said center aperture of the first annular ring and being substantially parallel to said central axis, and wherein said means for causing said arms to pivot includes each said arm also having a second pivot, and wherein said second pivot of each arm is simultaneously moved in a circle around said central axis to cause said arms to pivot.

2. The apparatus of claim 1 wherein the finger means comprises a plurality of fingers held together in a first substantially circular configuration and means for causing the plurality of fingers to be separated from each other in a second substantially circular configuration, the plurality of fingers being inserted into the partially opened open end when they are in the first substantially circular configuration and then being changed to the second substantially circular configuration, thereby opening the open end.

3. The apparatus of claim 2 wherein the means for partially opening the open end comprises means for producing a stream of air directed toward the open end until the fingers are inserted in the open end.

4. The apparatus of claim 2, further comprising means for detecting if the partially opened open end has not been completely opened and produced a signal to prevent an attempted insertion of an object into the bag.

5. The apparatus of claim 1 wherein the finger means opens the partially opened open end to form a substantially circular aperture.

6. The apparatus of claim 1 wherein the means for partially opening the open end comprises means for producing a stream of air directed through the open end toward the closed end of the bag until the finger means are inserted in the open end.

7. An apparatus for opening the open end of a flexible bag having a permanently closed end and an open end for placing an object of generally a similar shape as the shape of the fully opened open end into the bag, comprising:

means for partially opening the open end of the bag; and, finger means for inserting into the partially opened open end and expanding the open end substantially uniformly in all directions by pivoting the fingers simultaneously with a radial component after insertion thereinto to further open the partially opened open end into an object receiving condition, and means for delivering the object through the opened open end to contain the object within the bag, wherein the means for partially opening the open end comprises means for producing a stream of air directed through the open end toward the closed end of the bag until the finger means are inserted in the open end, wherein the finger means comprises a first annular ring having a center aperture having a central axis and a plurality of arms pivotally attached to said first annular ring, each arm having one of the fingers attached thereto and means for causing each of the arms to pivot, each of the fingers extending into said center aperture of the first annular ring and being substantially parallel to said central axis, and wherein said means for causing said arms to pivot includes each said arm also having a second pivot and wherein said second pivot of each arm is simultaneously moved in a circle around said central axis to cause said arms to pivot.

8. An apparatus for opening the open end of a flexible bag having a permanently closed end and an open end, comprising:

means for partially opening the open end of the bag;

finger means for inserting into the partially opened open end and expanding the open end substantially uniformly in all directions after insertion thereinto to further open the partially opened open end;

said means for partially opening the open end comprising means for producing a stream of air directed toward the open end;

said finger means comprising a first annular ring having a center aperture having a central axis and a plurality of arms pivotally attached to said first annular ring, each arm having one of the fingers attached thereto and means for causing each of the arms to pivot, each of the fingers extending into said center aperture of the first annular ring and being substantially parallel to said central axis; and each of the plurality of arms further comprises a pushed surface, means for causing each of the arms to pivot simultaneously comprising a second annular ring having a plurality of members projecting perpendicularly therefrom and each having a pushing surface, the second annular ring being parallel to and having its center along a common axis with the first annular ring, each of the members on the second annular ring engaging a corresponding pushed surface on a corresponding arm and causing the arms to pivot between the first configuration and the second configuration when the first and second annular rings are rotated relative to each other about their common axis.

* * * * *